US006244787B1

(12) United States Patent
Seegmiller

(10) Patent No.: US 6,244,787 B1
(45) Date of Patent: Jun. 12, 2001

(54) CABLE BOLT SPINNING TOOL

(76) Inventor: Ben L. Seegmiller, 143 S. 400 East, Salt Lake City, UT (US) 84111

( * ) Notice: Subject to any disclaimer, the term of this patent is extended or adjusted under 35 U.S.C. 154(b) by 0 days.

(21) Appl. No.: 09/441,298

(22) Filed: Nov. 17, 1999

(51) Int. Cl.[7] ..... B25B 13/06

(52) U.S. Cl. ..... 405/302.2; 405/259.1; 81/121.1; 81/186

(58) Field of Search ..... 405/259.1, 259.6, 405/302.2, 302.1, 302.3, 303; 81/121.1, 120, 186

(56) References Cited

U.S. PATENT DOCUMENTS 906,040 * 12/1908 Lucas ..... 81/120
1,590,200 * 6/1926 McGuckin ..... 81/120
3,161,090 * 12/1964 McLellan ..... 81/120
3,940,941 * 3/1976 Libert et al. ..... 405/259.6
5,511,909 * 4/1996 Calandra, Jr. et al. ..... 405/259.6
5,531,545 7/1996 Seegmiller et al. .
5,931,064 * 8/1999 Gillespie ..... 81/120

* cited by examiner

*Primary Examiner*—David Bagnell
*Assistant Examiner*—Frederick L. Lagman

(57) ABSTRACT

A tool for facilitating the spinning of a wire-strand cable bolt, the tool having a cable bolt end engagement socket which is configured to engage positively such cable bolt end an appreciable distance.

13 Claims, 5 Drawing Sheets

CABLE BOLT SPINNING TOOL

FIELD OF INVENTION

The present invention pertains to tools for facilitating the spinning of cable bolts about their longitudinal axis and, more particularly, to a tool having an interior socket, uniquely suited for driving engagement with a cable bolt end so that the spinning function can be achieved in a highly satisfactory manner.

BRIEF DESCRIPTION OF PRIOR ART

No art is currently known relative to a cable bolt spinning tool being designed with a type of cable bolt and socket receiving area, for positively engaging such end to accomplish the spinning function. however, for a general understanding of the cable bolt structure art, reference is made to the inventor's prior U.S. Pat. No. 5,531,545 issued Jul. 2, 1996. By way of introduction and lexography, the term cable bolt as used herein, and as used and understood generally in the art, refers to any cable length, with or without end or medial attachments, where such cable length is constituted by a central king wire about which is helically wrapped a series of wire strands. A customary, vertically oriented cable bolt will have six of such strands which are helically wrapped in a counter-clockwise direction going upwardly from the bottom end of the cable section to the top end thereof. When viewed at a point beneath the lower end of the cable bolt section, the strands will appear as proceeding toward the eye of the viewer as being wound in a clockwise direction.

Cable bolts are used in a variety of contexts such as tunnel constructions, mine roof stabilization and other industries wherein it is desired to enhance stability of earth formations. This is particularly important in the area of underground mining, wherein ground control of mine roof strata is to be enhanced, whether in a passive or in a dynamic manner. Cable lengths comprising cable bolts, as this term is employed herein, may be from 6 feet to 18 feet in length, or more, with the bolts being installed in bolt-holes proceeding from the commencement of the opening to its base. At the base there will be a deposit of an epoxy resin system which is to be made active and mixed upon the spinning of the cable bolt, whereby to positively secure the cable bolt end or portion within which it is positioned. Resin systems to accomplish such anchoring may have setup times anywhere from a few seconds to several minutes. What is needed therefor is a mechanism for facilitating the spinning of a cable bolt about its axis so as to mix the resin system whereby to accomplish the cable bolt anchoring function as desired.

There have been developed many types of anchoring structures for cable bolts, with resin system facility, to effect the resin system mixing function. Such facility per se forms no part of the invention. What the invention herein provides is a tool for facilitating the spinning of the wire strand cable bolt utilized, what ever its particular design.

The tool herein, in accomplishing the aforementioned spinning function, will be utilized with power machinery of conventional design, whereby to engage the tool and spin the same so that the latter, in its engagement with the wire strand cable bolt, will spin the latter about its longitudinal axis. Spinning machinery is commonly in the art, are of various designs, and include the large mobile bolter machinery, "stopers," i.e., stoping drill machinery, jackleg drills and the like. Such machinery will include a chuck or similar structure suitable to grib and/or receive and intermediate tool, whereby the rotating power of the power machinery is transferred by the tool for actually spinning the cable bolt.

What the present invention provides in particular, is a tool having a head provided with an interior socket designed to receive the end of a cable bolt in a unique manner, for positive engagement of the same throughout an appreciable length of the cable bolt end.

BRIEF DESCRIPTION OF THE PRESENT INVENTION

According to the present invention the tool herein basically comprises an elongated shank and a head integral with the shank. The shank has a preferred, noncircular transverse cross-section designed for reception of the chuck or other engagement portion of power equipment. Medially disposed upon the shank will be a transverse peripheral raised portion such as a fixed retainer ring for accommodating the tool for retention in the driving equipment and to preclude axial slippage. The head of the tool includes a cable bolt end admittance cavity which bottoms into a unique cable bolt end engagement socket. The admittance cavity may include one or more conical surfaces for facilitating the easy implacement of the tool over a cable bolt end such that the end is suitably engaged in the socket area. Cable bolts, again, are customarily made up of a central or king wire surrounded by six wire strands that are helically wound about the king wire. The strands proceed in a counter-clockwise direction, from rearward to forward. For maximum engagement strength, this requires that the socket area be suitably designed either with grooves for receiving the outer surfaces of the cable strands or, and preferably, be configured by displaced hexagonal socket portions which will grip at different but adjacent portions of the cable end. In this way the tool can be twisted slightly so that an appreciable depth of the cable end can be accommodated by the bifurcated noncircular socket portions of the tool head. Accordingly, when viewed from a lower point looking upwardly, the lower most socket portion of the head will be displaced slightly, i.e., 10° to 12°, in a clockwise direction relative to the socket portion that is above it. Again, where the socket portions have hexagonal cross-sections, the innermost portion being angularly displaced relative to the remaining portion, then the tool can be advanced and simply twisted slightly as the cable bolt is engaged, whereby adjacent surface portions of the cable bolt are positively retained in such hexagonal socket portions or segments.

OBJECTS

Accordingly, a principle object of the present invention is to provide a tool for facilitating the spinning of wire strand cables such as ground stabilization cable bolts.

A further object is to provide a tool for engaging a cable bolt to be spun whereby the end of the latter is engaged by the former in a positive manner such as to preclude inadvertent rotational slippage.

A further object of the invention is to provide an elongated tool for spinning cable bolts wherein the same is provided with a composite interior socket designed for engaging a substantial portion of the periphery of a cable bolt end.

A further object is to minimize machining and fabrication expense in the production of a cable bolt rotating tool, wherein the same includes an interior socket section suitable for positively engaging the bolt end about a substantial portion of its end periphery.

IN THE DRAWINGS

The present invention both as to organization and manner of operation may best be understood by reference to the following description taken in connection with the accompanying drawings in which:

FIG. 4A likewise illustrates that a pair of inner conical surfaces are supplied the head for receiving and centering the cable bolt end to be engagedly placed therein.

Figure 6A:
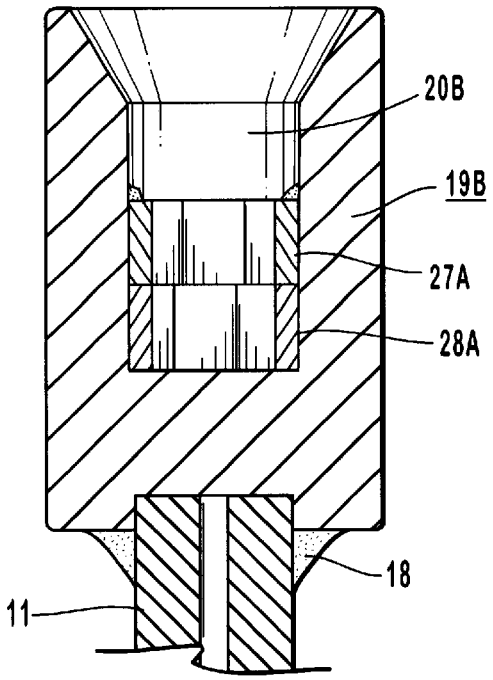
FIGS. 6A and 6B are alternative sub-embodiments, correspond to FIGS. 4A and 4B and illustrate, in other modifications of the invention, that separate socket members can be used for implantation within the head, being welded or otherwise secured thereto.
Figure 6B:
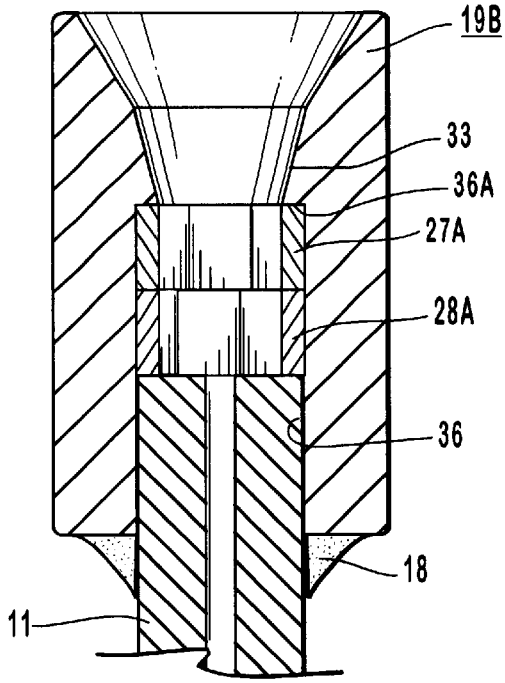
Figure 7A:
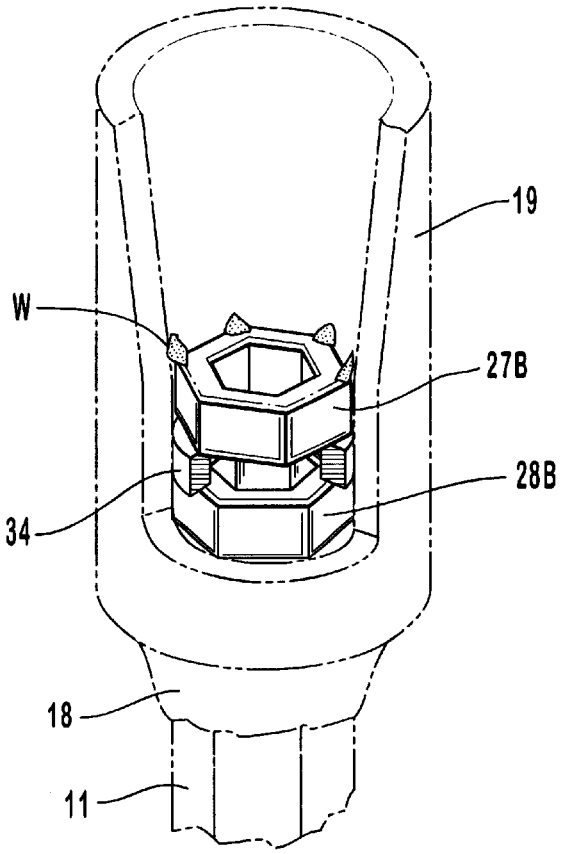
Figure 7B:
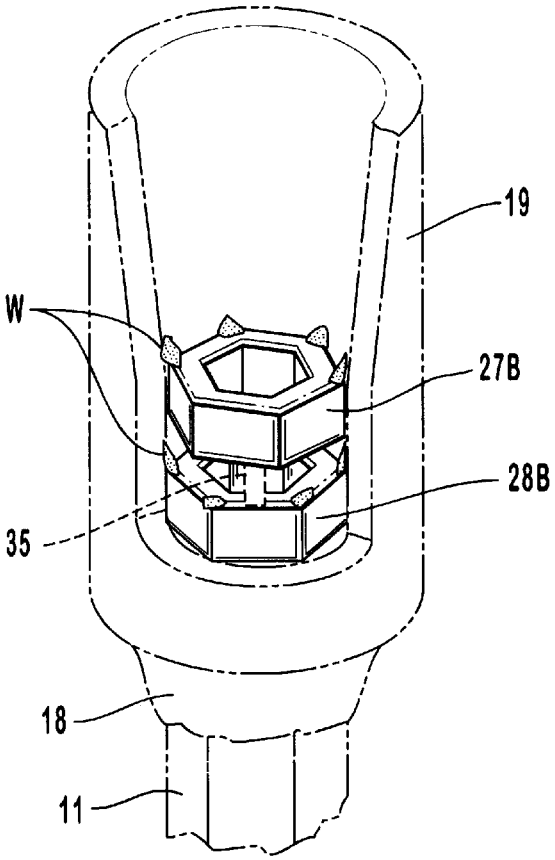

FIGS. 7A and 7B illustrate that a spacer of some appropriate type can be employed between the two socket elements or members for spacing the socket members apart so as to enlarge the grip thereof relative to the end of the cable bolt; in such circumstances, the socket members will enjoy a mutual angular displacement somewhat greater than when the socket elements are immediately adjacent as FIGS. 6A and 6B.

DETAILED DESCRIPTION OF PREFERRED EMBODIMENTS

Figure 1:
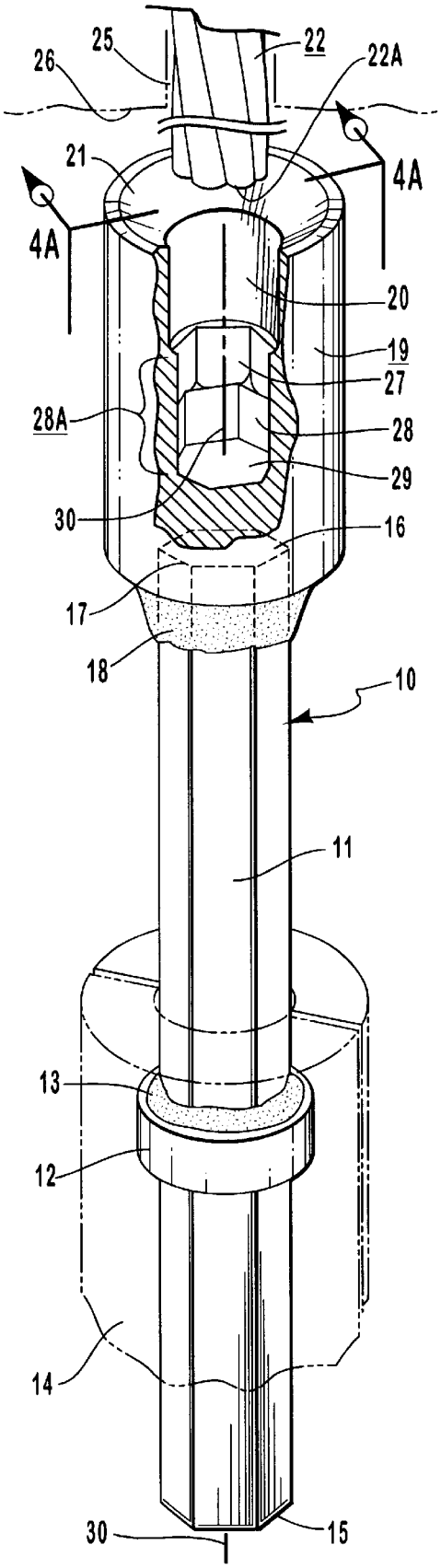
FIG. 1 is a perspective view of the tool of the present invention shown about to be engaged with the protruding end of a cable bolt to be secured in a mine roof borehole, for example.
Figure 2A:
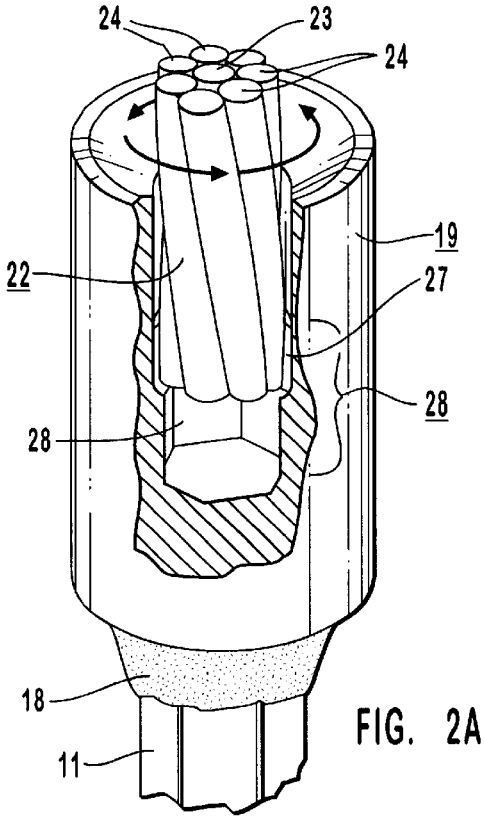
FIG. 2A is an enlarged view of the upper portion of the tool of FIG. 1.
Figure 2B:
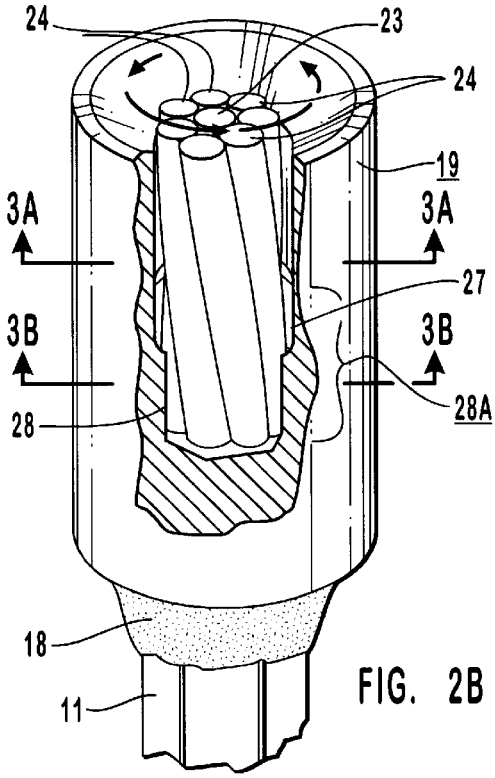
FIG. 2B is similar to FIG. 2A but includes a pair of adjacent cable bolt receiving conical surfaces relative to the admittance cavity of the head of the tool.

In FIG. 1 tool 10 includes an elongated shank 11 of noncircular transverse cross-section, preferably being hexagonal in shape. Medially disposed upon elongated shank 11 is a transverse peripheral raised portion 12, welded in place 13, and which can simply take the form of a retainer ring. This retainer ring or peripheral portion in all likelihood will be useful in positioning the elongated shank of the tool against axial slippage as the same is grasped by power driver 14 associated with heavy equipment such as a stoper, jackleg drill machine, or mobile bolter machinery. Where the latter include a chuck, then this portion will surround the elongated shank as indicated by the phantom line at 14, the peripheral portion 12 serving as a retention ring to prevent axial slippage of the tool as the same as power driven by the power equipment utilized in connection with structure 14. Elongated shank 11 includes a rearward or lower end 15 and also a forward or upper end 16, the latter advancing into a hexagonal or other suitable seat at 17 preparatory for the application of a weld at 18. The seat insert 17 is axially aligned with the base of head 19, the same including a cable bolt end admittance cavity 20 which may include one or more conically tapered surfaces 21. This latter surface, or surfaces as the case may be, is provided for easy centering of the tool over the cable bolt end. A standard cable bolt length 22 is seen in FIGS. 1, 2A and 2B, for example, and customarily comprises a king wire 23 about which are disposed helically disposed strands 24 as illustrated in FIG. 2A. Generally six strands are supplied and are helically wound about the king wire 23, this in a manner such that when one looks upwardly toward the bottom end of the cable bolt, the peripheral strands are seen to advance downwardly helically, toward the eye, in a clockwise direction.

Conically tapered surface 21 may be supplied to augment the easy insertion of the tool over the protruding cable bolt end 22A which proceeds out of its borehole 25 within strata area 26.

Disposed within the head is a composite socket area 28A comprising first and second socket portions 27 and 28, the latter being found proximate the bottom 29 of the head cavity. The composite socket area 28A including socket portions 27 and 28 will be generally centered relative to their common axis 30, as is also the axis of shank 11.

It is important to observe that the first and second, upper or forward, and lower or rearward socket portions 27 and 28 are mutually angularly displaced relative to one another, the second socket portion being advanced slightly in a counterclockwise direction, looking up, relative to the first socket portion. This is for enabling the tool to be advanced upwardly and gradually twisted clockwise, looking up, over the cable bolt end at 22A such that the first socket portion engages the cable bolt end and, as the advance of the tool continues in an upward direction, the second socket portion engages the cable end. The reason why the socket portions are mutually displaced angularly is to accommodate the twisted nature of the helical strands of the cable bolt.

FIG. 2A illustrates a first penetration point of the cable bolt so that the same engages the first socket portion; subsequently, the tool continues its advance upwardly and is twisted slightly so that the cable bolt extreme end, see FIG. 2B, now nestles in the second socket portion 28.

Figure 3A:
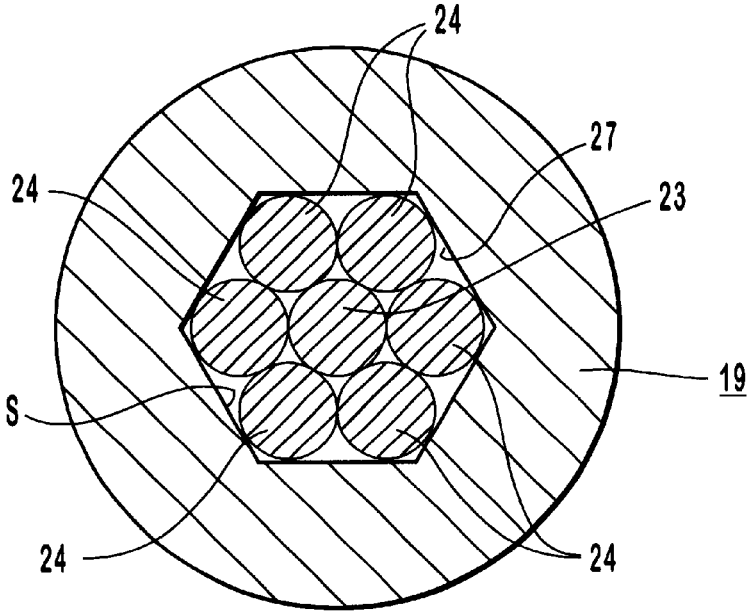
FIG. 3A is an enlarged, cross-sectional detail taken along the lines 3A—3A in FIG. 2B.
Figure 3B:
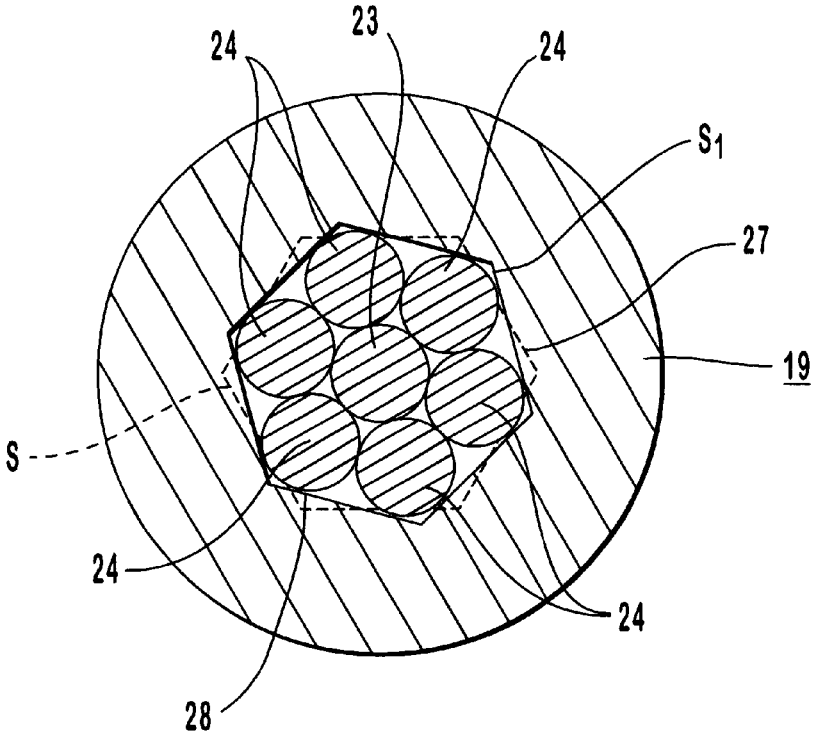
FIG. 3B is an enlarged, cross-sectioned detail taken along the line 3B—3B in FIG. 2B, illustrating that as the tool head is initially twisted and advanced upwardly over the end of the cable bolt, the helical strands of the cable bolt are engagedly accommodated by the mutually displaced socket portions of the tool.

FIG. 3A illustrates the configurement of the first socket portion 27 in the essentially tangential relationship of portions of the outer surfaces of wire strands 24 relative to the socket surface S. Correspondingly, socket surface SI of the lower, second socket portion 28 is seen in FIG. 3B to engage in an operative manner, and tangentially, the outer surfaces of the various wire strands of the cable bolt. It is to be noted that there is a slight angular displacement of the second socket portion 28, see FIG. 3B, relative to the phantom configurement of the first socket portion 27 in FIG. 3B corresponding to socket portion 27 in FIG. 3A.

Figure 4A:
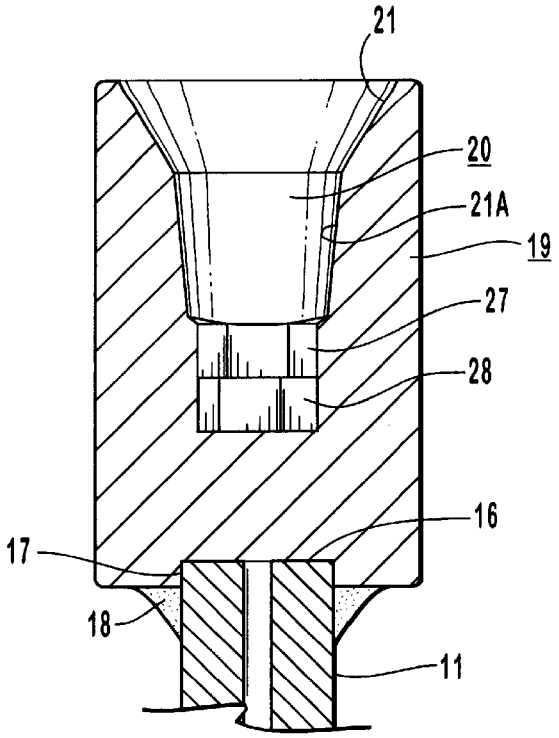
FIG. 4A is an enlarged vertical section, taken along the line 4A—4A in FIG. 1, illustrating the head of the tool wherein the same includes integrally formed mutually displaced socket portions for receiving the end of the cable bolt.

FIG. 4A, being a vertical cross-section of the head of FIG. 1 taken along the line 4A—4A, illustrates the head 19 this time has having at its cable bolt end admittance cavity 20 an annular, conical tapered surface 21 of pronounce taper and, intersecting therewith, an annular conical tapered surface 21A. Surface 21 accommodates the rough alignment of the tool with the cable bolt end, while a surface 21 A permits a gradual alignment to exact desired position of the cable bolt end as the same is advanced into the first socket portion 27 and then second socket portion 28. It is noted that these two socket portions are angularly displaced, whereby to allow both sockets portions to be active in tightly engaging the helically wound wires or strands of the cable bolt.

Figure 4B:
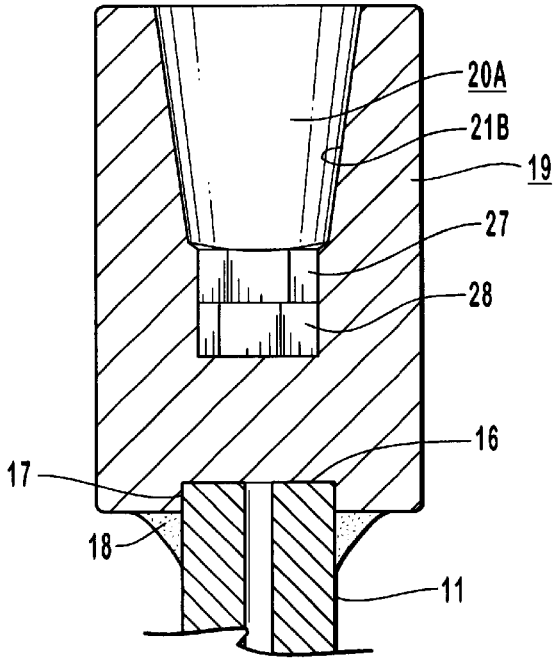
FIG. 4B is similar to 4A but illustrates simply a single conical surface, relative to the interior of the head, the same being designed to allow the convenient insertion of the head over the cable bolt end and permit the centering of the latter for engagement with the sockets.

FIG. 4B is similar in construction to FIG. 4A, with the exception that this time the cable bolt end admittance cavity 20A includes a single conical surface 21 B serving the purpose of progressively aligning the head 19 of the tool relative to the end of the cable bolt to be received at such cavity.

Figure 5A:
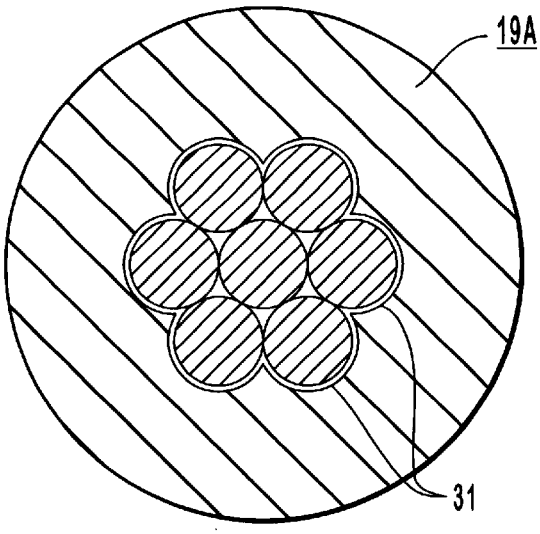
FIGS. 5A and 5B are enlarged transverse sections corresponding to another socket embodiment within the head of the tool, correspond with FIGS. 3A and 3B, respectfully, but illustrate that circular grooves are supplied the composite socket of the head of the tool whereby to permit a sliding rotative engagement of the head of the tool relative to the helically wound cable bolt.
Figure 5B:
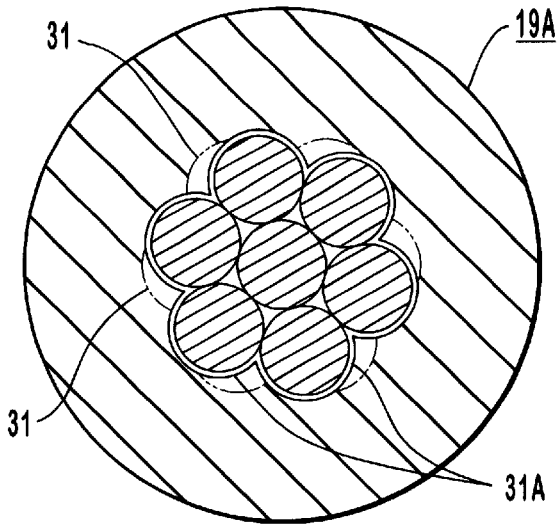

The tool head 19A at FIGS. 5A and 5B corresponds to the tool head 19 in FIGS. 3A and 3B, with the exception that, this time, the first and second socket portions have respective contiguous, wire strand receiving grooves 31 which are spiraled or helical in configuration and which flow into groove extensions 31A. In this way there may be a substantial engagement as between the head and its grooves and the helical wires of the cable end cross-section of the cable bolt.

In FIG. 6A the inner cavity 20B of head 19B is provided with a first and second socket portions 27A and 28A which may comprise individual, case hardened socket elements which are hexagonal, for example, both as to respective interiors and exteriors, the interiors being angularly displaced in the manner as taught in the embodiment of FIG. 1.

FIG. 6B is a structure similar to that of FIG. 6A, but illustrates an aperture extension 36 accommodating the upwards thrusting and placement in aperture 36 of the socket members against head interior shoulder 36A.

FIG. 7A illustrates a tool head 19 supplied with first and second socket members 27B and 28B which are secured by welding or other means to the interior of the head and which, additionally, are mutually spaced apart by spacer member 34. The spacer member 34 may take the form of a common spacer which has an opening larger than the hexagonal openings of the two socket members 27B and 28B.

FIG. 7B is similar to FIG. 7A but illustrates an optional means of inter-socket spacing can be employed at 35. As in the case of the structure seen in FIG. 6A, 6B, the structure of FIG. 7A and 7B likewise include the facility of the socket members being rigidly secured in place, as by spot-welding, within the head cavity and with a spacer being provided therebetween to enlarge the length of the gripping surfaces of the sockets. The wider apart the sockets selected, of course, the greater will be angular displacement between the socket members.

In all of the embodiments, see FIG. 1 by way of example, the operation is the same: The tool is advanced upwardly, e.g., so that the first and second socket portions or members engage a substantial portion of the exterior surface of the cable bolt end. Subsequently, power is supplied to a driver, see the bottom part of FIG. 1, for rotating the structure 14 to thereby rotate the shank and tool, thereby spinning the cable bolt in its borehole.

In the event that the cable bolt is made up of helical strands greater than six, as shown, then the number of interior faces of the socket can be correspondingly increased.

While particular embodiments of the present invention have been shown and described, it will be obvious to those skilled in the art that various changes and modifications may be made without departing from the essential features of the invention and therefore, the aim of the appended claims to cover such changes and modifications as may be made.

I claim:

1. A tool for facilitating the spinning of a wire-strand cable bolt including, in combination, an elongated shank having forward and rearward opposite ends, said shank having a transverse cross-section the periphery of which is non-circular; and a head integral with said forward end of said shank, said head being provided with a forwardly facing, cable-bolt-end admittance cavity and also a cable-bolt-end engagement socket interiorly adjacent said cavity, said socket having a central axis and a transverse, non-circular cross section, smaller in dimension than said cavity, and constructed to receive and operatively engage an end of an external cable bolt to be spun by said tool about its longitudinal axis.

2. The tool of claim 1 wherein said socket is provided with a plurality of cable-bolt, wire-strand-receiving recessed grooves mutually arranged helically about said socket axis.

3. The tool of claim 1 wherein said shank is provided with a medially disposed, transverse, peripheral, raised portion.

4. The tool of claim 1 wherein said shank has a transverse, hexagonal periphery.

5. A tool for facilitating the spinning of a wire-strand cable bolt including in combination, an elongated shank having forward and rearward opposite ends, said shank having a transverse cross-section the periphery of which is noncircular, and a head integral with said forward end of said shank, said head being provided with a forwardly facing cable-bolt-end admittance cavity and also a cable-bolt-end engagement socket interiorly adjacent said cavity said socket having a central axis and a transverse noncircular cross section constructed to receive and operatively engage an end of an external cable bolt to be spun by said tool about its longitudinal axis, and wherein said socket comprises forward and rearward, mutually adjacent socket portions each of hexagonal configurement, said socket portions being transversely mutually angularly displaced whereby jointly to accept in operative engagement helical wire strands of an external cable bolt end.

6. The tool of claim 5 wherein the interior of said head is provided with a pair of proximately spaced socket members secured within said head whereby to define said socket portions.

7. The tool of claim 5 wherein the interior of said head at said socket is provided with mutually spaced apart socket members respectively comprising said socket portions, said socket members being secured within said head whereby to define said socket portions.

8. The tool of claim 7 wherein a spacer member is disposed between said socket members.

9. A tool for facilitating the spinning of a wire-strand cable bolt including, in combination an elongated shank having forward and rearward opposite ends, said shank having a transverse cross-section the periphery of which is non-circular; and a head integral with said forward end of said shank, said head being provided with a forwardly facing, cable-bolt-end admittance cavity and also a cable-bolt-end engagement socket interiorly adjacent said cavity said socket having a central axis and a transverse, non-circular cross section constructed to receive and operatively engage an end of an external cable bolt to be spun by said tool about its longitudinal axis, and wherein said socket comprises forward and reward, mutually adjacent socket portions each of hexagonal configurement, said rearward socket portion being transversely angularly displaced in a counter-clockwise direction, looking rearwardly, relative to said forward socket portion, whereby to accept, with said forward socket portion, the forwardly extending, clockwise-helically-wound, looking rearward, surface strands of an external cable bolt.

10. A tool for facilitating the spinning of a wire-strand cable bolt including, in combination, an elongated shank having forward and rearward opposite ends, said shank having a transverse cross-section the periphery of which is non-circular, and a head integral with said forward end of said shank said head being provided with a forwardly facing, cable-bolt-end admittance cavity and also a cable-bolt-end admittance cavity and also a cable-bolt-end engagement socket interiorly adjacent said cavity said socket having a central axis and a transverse, non-circular cross section constructed to receive and operatively engage an end of an external cable bolt to be spun by said tool about its longitudinal axis, and wherein said admittance cavity is smooth-surfaced and conically configured.

11. A tool for facilitating the spinning of a wire-strand cable bolt including, in combination, an elongated shank having forward and rearward opposite ends, said shank having a transverse cross-section the periphery of which is non-circular, and a head integral with said forward end of said shank, said head being provided with a forwardly facing, cable-bolt-end admittance cavity and also a cable-bolt-end engagement socket interiorly adjacent said cavity, said socket having a central axis and a transverse, noncircular cross section constructed to receive and operatively engage an end of an external cable bolt to be spun by said tool about its longitudinal axis, and wherein said admittance cavity is defined by as inner surface of said head composed of contiguous, smooth-surfaced, conical surfaces of increasing taper, progressing outwardly.

12. A tool for facilitating the spinning of a wire-strand cable bolt including, in combination, an elongated shank having forward and rearward opposite ends, said shank having a transverse cross-section the periphery of which hexagonal; and a head integral with said forward end of said shank, said head being provided with a forwardly facing, cable-bolt-end admittance cavity and also a cable-bolt-end engagement socket interiorly adjacent said cavity, said socket having a central axis and a transverse, essentially hexagonal cross section constructed to receive and operatively engage an end of an external cable bolt to be spun about its longitudinal axis.

13. The tool of claim 12 wherein said socket is bifurcated into a pair of axially adjacent portions mutually angularly displaced relative to each other.

* * * * *